US005772613A

United States Patent [19]

Gelfand et al.

[11] Patent Number: 5,772,613

[45] Date of Patent: Jun. 30, 1998

[54] CARDIOPULMONARY RESUSCITATION SYSTEM WITH CENTRIFUGAL COMPRESSION PUMP

[75] Inventors: Mark Gelfand; Neil S. Rothman, both of Baltimore, Md.

[73] Assignee: Cardiologic Systems, Inc., Baltimore, Md.

[21] Appl. No.: 731,049

[22] Filed: Oct. 9, 1996

[51] Int. Cl.[6] ..... A61H 31/02

[52] U.S. Cl. ..... 601/41; 601/1

[58] Field of Search ..... 601/1, 41–44, 601/149–152; 128/DIG. 20

[56] References Cited

U.S. PATENT DOCUMENTS

| | | |
|---|---|---|
| 2,169,784 | 8/1939 | Andersen . |
| 2,762,366 | 2/1956 | Huxley, III et al. . |
| 2,833,275 | 5/1958 | Tunnicliffe . |
| 2,869,537 | 1/1959 | Chu . |
| 3,167,067 | 1/1965 | Rand . |
| 3,566,862 | 3/1971 | Schuh . |
| 4,077,400 | 3/1978 | Harrigan . |
| 4,311,135 | 1/1982 | Brueckner et al. . |
| 4,349,015 | 9/1982 | Alferness . |
| 4,397,306 | 8/1983 | Weisfeldt et al. . |
| 4,424,806 | 1/1984 | Newman et al. . |
| 4,520,820 | 6/1985 | Kitchin et al. . |
| 4,664,098 | 5/1987 | Woudenberg et al. . |
| 4,770,164 | 9/1988 | Lach et al. . |
| 4,838,263 | 6/1989 | Warwick et al. . |
| 4,840,167 | 6/1989 | Olsson et al. . |
| 4,881,527 | 11/1989 | Lerman . |
| 4,928,674 | 5/1990 | Halperin et al. . |
| 4,971,042 | 11/1990 | Lerman . |
| 5,000,164 | 3/1991 | Cooper . |
| 5,056,505 | 10/1991 | Warwick et al. . |
| 5,076,259 | 12/1991 | Hayek . |
| 5,222,478 | 6/1993 | Scarberry et al. . |
| 5,307,791 | 5/1994 | Senoue et al. . |
| 5,361,418 | 11/1994 | Luzenske . |
| 5,370,603 | 12/1994 | Newman . |
| 5,453,081 | 9/1995 | Hansen . |
| 5,490,820 | 2/1996 | Schock et al. . |

OTHER PUBLICATIONS

"Mechanical CPR is Said to Improve Blood Flow", *New York Time* article, Sep. 1988.

"Emergency Medical Technology", SurTech, HLR Heart–Lung Resuscitator Performs the ABC'S of Cardio–Pulmonary Resuscitation (CPR).

"Augmentation of Carotid Flow During Cardiopulmonary Resuscitation by Ventilation at High Airway Pressure Simultaneous With Chest Compression,"N. Chandra, M.D. et al, *The American Journal of Cardiology,* vol. 48, Dec. 1981, pp. 1053–1063.

(List continued on next page.)

*Primary Examiner*—Jerome Donnelly
*Attorney, Agent, or Firm*—Nixon & Vanderhye P.C.

[57] ABSTRACT

A blower pressure source has been integrated into a vest cardiopulmonary resuscitation (CPR) system. The vest includes a bladder that cyclically inflates and deflates to provide automatic CPR to a patient in cardiac arrest or needing circulatory assistance to a patient with a beating but weakened heart. The blower continuously provides air at relatively low pressure to inflate a bladder in the vest. The maximum pressure of the blower corresponds to the desired peak vest pressure. A relatively simple valve, solenoid and timing controller is used to apply the blower air in cycles to inflate the bladder.

6 Claims, 2 Drawing Sheets

OTHER PUBLICATIONS

"Regional Blood Flow During Cardiopulmonary Resuscitation in Dogs Using Simultaneous and Nonsimultaneous Compression and Ventilation," J. Luce, M.D. et al, Dept. of Medicine . . . Univ. of Washington School of Medicine, Seattle, Washington, Circulation 67, No. 2, 1983, pp. 258–265.

"Mechanical 'Cough' Cardiopulmonary Resuscitation During Cardiac Arrest in Dogs," J. Niemann, M.D. et al, Dept. of Emergency Medicine, . . . UCLA School of Medicine, Torrence, California, etc. pp. 199–204.

AFCR Cardiovascular, p. 161A.

"Augmentation of Cardiac Function by Elevation of Intrathoracic Pressure," M. Pinsky et al, American Physiological Society, pp. 950–955.

"Hemodynamic Effects of Cardiac Cycle–Specific Increases in Intrathoracic Pressure," M. Pinsky et al, American Physiological Society, pp. 604–612.

"Programmable Pneumatic Generator for Manipulation of Intrathoracic Pressure," H. Halperin, M.D. et al, IEEE Transactions of Biomedical Engineering, vol. BME–34, No. 9, Sep. 1987, pp. 738–742.

"Intrathoracic and Abdominal Pressure Variations as an Efficient Method for Cardiopulmonary Resuscitation: Studies in Dogs Compared With Computer Model Results," R. Beyar et al, Cardiovascular Research, 1985, 19, 335–342.

"Vest Inflation Without Simultaneous Ventilation During Cardiac Arrest in Dogs: Improved Survival from Prolonged Cardiopulmonary Resuscitation," H. Halperin, M.D. et al, Dept. of Medicine, The Johns Hopkins Medical Institutions, Baltimore, vol. 74, No. 6, Dec. 1986, pp. 1407–1415.

Fig. 1
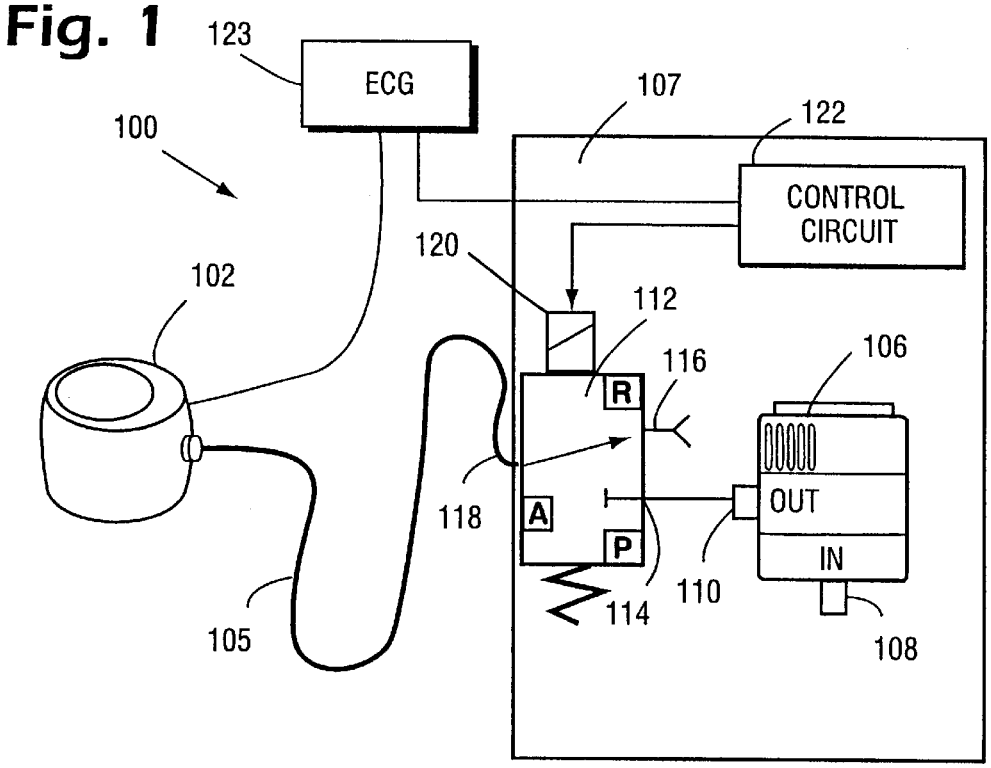
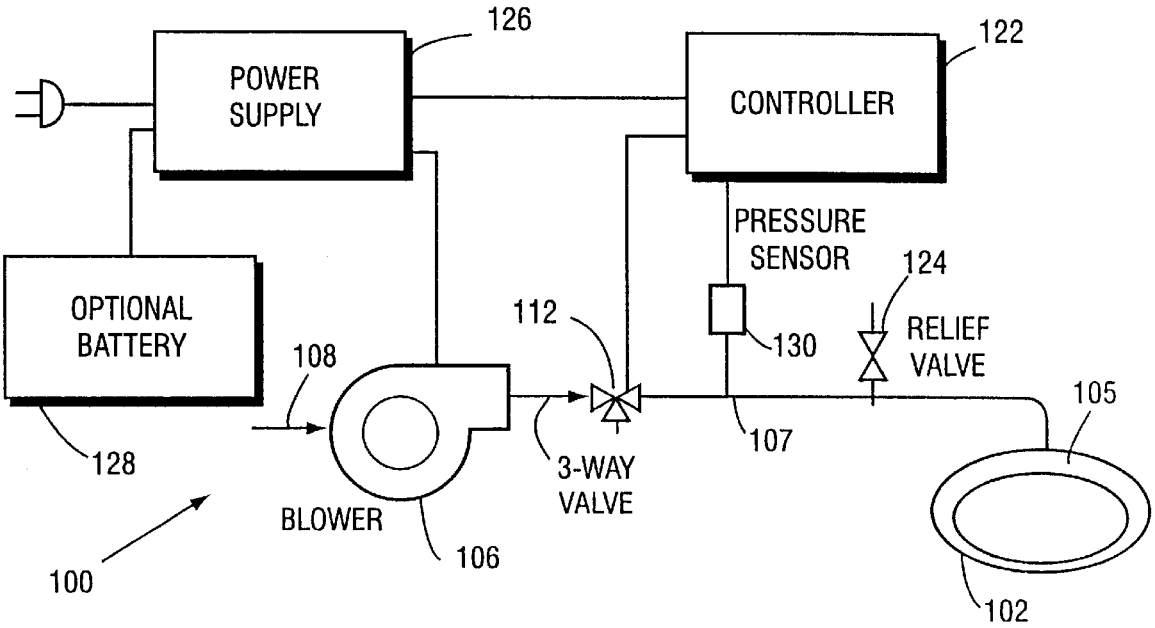
Fig. 2

CARDIOPULMONARY RESUSCITATION SYSTEM WITH CENTRIFUGAL COMPRESSION PUMP

BACKGROUND AND SUMMARY OF THE INVENTION

1. Field of Invention

The current invention relates to emergency medical equipment and treatment for cardiac arrest. In particular, the invention relates to cardiopulmonary resuscitation and cardiopulmonary circulatory assist devices that cyclically apply compressive pressure to a patient's thorax to increase intrathoracic pressure to force blood flow through the heart and other body organs.

2. Background of the Invention

More than one in four Americans have cardiovascular disease, which is the leading cause of sudden cardiac arrest (SCA) and a leading cause of death in the United States. It is estimated that each year in the United States, approximately 1.5 million people suffer a heart attack, resulting in more than 400,000 people experiencing an SCA episode, of whom at least 85% will die as a result. Approximately every minute there is a sudden cardiac arrest in the United States.

SCA is generally due to ventricular fibrillation, a life-threatening condition, in which the heart's normal electrical signals become chaotic, causing the cessation of effective pumping of blood by the heart. Blood carries oxygen to the body. If the blood flow stops, the body stops receiving oxygen. Irreversible organ damage will occur if blood flow is not restored promptly. The body, especially the brain and heart muscle, cannot survive beyond a few minutes without oxygenated blood flow.

The optimal first line of treatment for ventricular fibrillation, the most common cause of cardiac arrest, is defibrillation (the delivery of a high-energy electrical shock to the chest). Successful defibrillation stops the chaotic electrical activity and allows regular electrical activity to again produce normal heart rhythm. If the heart muscle has been deprived of oxygen by a lack of blood flow for more than a few minutes, defibrillation attempts are usually unsuccessful at restoring the heart to a normal rhythm. Similarly, the lack of oxygenated blood flow through the body will rapidly cause irreversible damage to vital organs including the brain. Medical defibrillation equipment is expensive, and dangerous in the hands of unskilled persons. Such equipment is usually only found in hospitals, doctors offices, and well-equipped mobile emergency units. Accordingly, medical defibrillation equipment is not often nearby when a patient suffers cardiac arrest.

Manual cardiopulmonary resuscitation (CPR) is most often used on cardiac arrest patients in the first critical minutes of cardiac arrest. Since 1960, manual CPR has been promoted as the standard means for providing oxygenated blood to the heart and brain until appropriate definitive medical treatment can restore normal heart and ventilator action. A primary objective of CPR is to generate blood flow to restore the heart to a condition that will allow successful defibrillation thereby causing the heart to resume normal beating. Another key objective of CPR is to provide blood flow to the brain and other organs to prevent irreversible organ damage while attempts at defibrillation are made.

Despite the widespread application of standard manual CPR, the average long-term survival rate from SCA is only about 15%, and may be lower if the SCA event occurs out of a hospital. Approximately 90% of the 350,000–400,000 persons who experience out-of-hospital sudden cardiac arrest in this country per year are served by local emergency medical teams whose directive is to initiate and maintain a resuscitative effort. The emergency teams transport patients to the hospital, but only 20% of individuals struck with cardiac arrest and who are treated by an emergency medical team survive to be discharged from the hospital. The poor survival rate for SCA is due, in part, to the inability of manual CPR to generate substantial blood flow, as well as the variability in the skill, strength, experience, fatigue or emotional state of the rescuer.

Most SCA episodes occur outside the hospital. The first medical professionals to reach a patient suffering from cardiac arrest are emergency paramedics. Upon arrival of an emergency medical vehicle, the emergency personnel applies a series of defibrillation attempts, which, if they fail to restart the heart, are followed by a rigorous procedure combining CPR with ventilation and additional defibrillation applications. If the heart muscle has been deprived of oxygen by a lack of blood flow for more than a few minutes, defibrillation attempts before administering CPR are usually unsuccessful at restarting the heart. Given that emergency medical response times to out-of-hospital SCA episodes are generally six to ten minutes, initial defibrillation attempts generally fail, thus necessitating that the combined routine of CPR and defibrillation be utilized. If the emergency medical vehicle is not equipped with a defibrillator, then the emergency response personnel generally relies on manual CPR to restart the victim's heart.

In manual CPR, a patient is placed on his back and the hands of the rescuer applying CPR are rhythmically pressed firmly against the center of the sternum on the patient's chest, i.e., thorax. By pressing on the sternum, the rescuer compresses the patient's thorax (chest cavity) to increase the pressure within the thorax and around the heart and intrathoracic vascular system. A primary aim of manual CPR is to increase intrathoracic pressure due to a decrease in thoracic volume produced by the displacement of the sternum. The rhythmic press and release by CPR of pressure around the heart forces blood to flow through the heart and the rest of the body.

A principal problem with conventional closed chest CPR is the inability to adequately produce sufficient blood flow to the brain and heart needed for survival. Animal studies have documented coronary and cerebral blood flows during CPR to be less than 5% and 10% of the pre-arrest values, respectively. Animal and human studies have determined that coronary perfusion pressure (CPP) is the best predictor of the success of myocardial recovery. During arrest, the coronary vasculature is believed to be fully dilated due to global ischemia (lack of blood flow and tissue perfusion). Accordingly, coronary blood flow should be directly related to the amount of CPP that can be generated with CPR. Studies indicate that a CPP of at least 15 mm Hg is required for successful myocardial resuscitation. If CPP is maintained at a level approaching 25 mm Hg, then many patients in cardiac arrest should be resuscitated. Restoration of coronary and cerebral perfusion flow are major determinants of the outcome of CPR. The duration of time during which the patient has no flow (from cardiac arrest to initiation of CPR) and the duration of CPR to return of spontaneous circulation (ROSC) are both crucial to the survival of the patient.

Chest compression occurs when the anterior and posterior thorax surfaces are moved toward one another, "flattening" the chest (anterior refers to the front of the thorax, posterior to the back). Chest compression is accompanied by an increase in the pressure within the thoracic cavity, and a decrease in the volume of the lungs. The decrease of the volume of the lungs is minimized by quickly trapping air in the lungs when starting compression of the chest. The increase in intrathoracic pressure forces blood through the heart and out toward the brain and extremities.

The amount of pressure needed to be applied to the chest for effective CPR is relatively great. Manual CPR often fails because inadequate pressure is applied to the chest by the hands of the person applying CPR. Moreover, the amount of force needed to achieve effective CPR is slightly below the force level which will traumatize the patient. Manual CPR often results in trauma to the patient's thorax because the person applying CPR applies excessive force to a small area on the chest in an effort to compress the heart. The most common injuries from manual CPR include injuries to the skin, bony thorax and upper airway. The reported incidence of injuries from CPR ranges from 21% to more than 65%. Accordingly, even properly executed manual CPR can lead to injury.

Applicants designed a vest-CPR system to increase intrathoracic pressure and intravascular pressure to produce blood flow using a continuous blower to directly pressurize the vest. The maximum output pressure of the blower corresponds to the desired peak vest pressure. The blower is a self-regulating source of vest pressure that does not require the complex and expensive regulators used in prior vest systems.

A CPR-vest is a belt that fits snugly around the thorax of a patient in cardiac arrest or requiring a cardiac assist. The vest includes a bladder underneath the belt and covering at least the front of the patient's thorax and preferably covers at least three fourths of the circumference of the chest. The bladder is connected by a pneumatic hose to an air supply and controller that rhythmically pressurizes and depressurizes the bladder. When pressurized, the bladder presses against the entire front of the thorax, from the armpits to the bottom of the rib cage to increase intrathoracic pressure.

By applying circumferential compression to reduce chest volume, vest-CPR increases intrathoracic pressure to increase the vascular pressure and force blood flow through the heart, lungs and other body organs. An initial rapid inflation of the vest bladder and corresponding increase in intrathoracic pressure traps air in the lungs to prevent excessive deflation of the lungs. By trapping air in the lungs, the continued inflation of the bladder results in fast increases of intrathoracic pressure with minimal inflation of the bladder because the trapped air in the lungs assists in increasing intrathoracic pressure. In addition, defibrillation electrodes may be positioned underneath the CPR vest to apply an electric shock while the CPR vest is operating.

Prior vest-CPR systems, such as shown in U.S. Pat. No. 4,928,674, have employed sources of high pressure air, e.g., air tanks (50–70 psi) to rapidly inflate the vest. High pressure air was believed to be necessary to provide enough force to quickly move the necessary amount of air into the vest bladder to achieve the desired rapid vest inflation and compression of the patient's thorax. Because the vest has to be cyclically inflated and deflated approximately 50 to 60 times per minute, the vest must inflate in less than 100 to 150 milliseconds. To provide high pressure air, air tanks were pressurized to levels much higher than the desired peak vest pressure. When the vest was inflated, air rushed from the tank to the vest, and the pressure in the tank dropped as the pressure in the vest rose. Computer controllers and pressure regulators monitored the vest pressure and stopped the air flow from the tank as the vest reached the desired peak pressure. The tank was repressurized by pumps, e.g., rotary-vane pumps, that continually provided highly pressurized air to the tank. The mass of air provided by the pump was relatively small as compared to the air needed to pressurize the vest. The pumps worked continually during the vest inflation and deflation cycles, and the mass of air pumped into the tank over time was sufficient to inflate the vest during the relatively-brief inflation period of the entire cycle of the vest.

The high pressure source typically included a positive displacement pump, e.g., a piston in cylinder pump, and a high pressure metal air tank. Such sources of high pressure air are capable of pressurizing the CPR-vest to a pressure that would burst the bladder, and potentially harm the patient. Accordingly, during normal operation, a CPR vest is pressurized to a much lesser pressure than the pressure of the source of pressurized air used to inflate the vest. To inflate the vest to the same pressure as the source of pressurized air could result in too much compression being applied to the patient's thorax, trauma to the patient, and damage to the CPR vest.

The high pressure air used to inflate CPR vests required safeguards to prevent over-inflation and sophisticated controllers to control the inflation and deflation cycles. While high pressure air provides rapid inflation, it presents a danger in that the vest may be over inflated. Because the forces needed for effective CPR are only slightly below the level of forces that will harm and traumatize the chest of the patient, safeguards were included in prior vest inflation systems to ensure that the vest was sufficiently pressurized for effective CPR, and to avoid applying excessive and harmful forces to a patient's chest.

To avoid over-inflation of the vest, computer controllers and complex valve systems have been used. For example, prior vest-CPR systems have included microprocessors programmed to monitor the pressure in the vest as the vest is inflated and activate the closing of pressurization valves prior to the pressure in the valve attaining the desired pressure. The activation of the pressure valves was precisely timed in advance of the vest reaching the desired pressurization because an inherent delay in activating the valves allowed additional high pressure air to continue entering the vest and further increase vest pressure. The microprocessor for the vest-CPR system was programmed to advance the valve activation command to compensate for the valve activation delay. In addition, the peak pressure at each vest inflation cycle fluctuates from cycle to cycle because of the rapid pressure rise in the vest occurring when the pressure valve is closed and because the valve is closed based on a prediction made by a microprocessor of when the vest will be fully pressurized. Due to the uncertainties in predicting when full pressurization will occur during a rapid pressure rise and the rapid pressure rise occurring in the vest at the peak pressure, the peak pressure actually attained in the vest varies from cycle to cycle.

Prior microprocessor independent controlled safety systems monitored the pressure in the CPR vest in addition to the monitoring performed by the microprocessor controlling pressurization of the vest. For example, the safety system would close the inflation valve and vent the vest if the pressure in the vest became too great. Moreover, the high pressure source required that prior vest-CPR systems have high pressure hoses and couplings that tend to be expensive and difficult to operate. Accordingly, the high pressure air needed to rapidly inflate the vest required expensive and complex control and safety systems that increased the cost of vest-CPR systems, increased the number of components and systems that could malfunction, and increased the difficulty in operating the vest-CPR system.

The efforts to develop a commercially viable vest-CPR have encountered difficulties due to the need for a high pressure air source. While high pressure air has been considered essential to rapidly inflate a vest and to allow for sufficient capacity in the inflation system for all sizes and shapes of patients, supplying and controlling air under high pressure is complex, expensive and problematic. An electric positive displacement pump, e.g., a piston or rotary vane pump, is the most common source of high pressure air in existing vest-CPR systems. Electric air pumps are one of the more expensive components of existing vest-CPR systems, often require electrical power greater than that supplied by ordinary 120 volt AC outlets, and require maintenance. The cost of an electric air pump that supplies 18–22 scfm of 50–70 psi air may be $500–$2,000 (US), which adds substantially to the cost of a vest-CPR system. Most electric air pumps this powerful require a 220 volt AC connection, which are not readily available in hospital emergency rooms or other locations where vest-CPR systems are used. Accordingly, there has been a long-felt need in CPRvest systems to solve the problems associated with high pressure air sources.

SUMMARY OF THE INVENTION

A vest-CPR system has been developed that has a self-regulating blower air source selected to have a maximum output air pressure equal to the desired maximum pressure of an inflatable CPR vest. The system does not require a high pressure air source as do the prior art systems. The problems and complexities associated with high pressure air have been solved by using a source of relatively-low pressure air, but provided by a relatively high volume air source. Breaking from the conventional wisdom that a source of high pressure air is needed for vest-CPR systems, applicant has developed a system in which a source that provides high volume air at relatively low pressures can rapidly inflate a CPR vest. The low pressure source of air may be a centrifugal compressor or blower (collectively referred to here as blowers) that are sized to provide the large volume of air needed to rapidly inflate a CPR vest, without over pressurizing the vest or subjecting the vest-CPR system or patient to high pressure air.

The operating characteristics (see FIG. 4) of a blower are such that as the pressure rises, the air mass flow through the blower decreases. At low pressures, the blower provides its maximum mass flow rate and rapidly inflates the vest. This rapid initial inflation of the vest is sufficient to rapidly compress the patient's thorax and trap air in the lungs to facilitate the application of intrathoracic pressure. As the outlet pressure of the blower rises (which outlet pressure corresponds to the back pressure from the vest), the air mass flow rate gradually slows. The slowing of the mass flow through the blower results in a slowing of the rate of pressurization of the CPR vest. The pressurization of the vest will rise gradually until the back pressure applied to the blower stops the air flowing through the blower at the maximum blower pressure. The entire vest inflation phase will occur in a few hundreds of milliseconds, which is fast enough to accomplish air trapping and effective chest compressions.

The blower is sized, e.g., flow rate and pressure characteristics, so that its maximum discharge output pressure corresponds to the desired peak pressure for the vest. Since the blower cannot exceed its maximum discharge pressure (which is fixed for a given rotating speed for a specific blower), the blower cannot over pressurize the vest. The positive displacement air pumps previously used in vest-CPR systems tended to have maximum attainable pressures much greater than the peak pressure desired in the vest and could pressurize the vest to levels that were potentially harmful to the patient and the vest. While positive displacement air pumps, e.g., rotary vane pumps, tended not to be limited by the back pressure applied by the vest, blowers are limited by back pressure from the vest. Accordingly, once the vest back pressure reaches the maximum output pressure of the pump, the blower is not capable of pumping more air into the vest. In the present invention, the blower is selected such that its air mass flow and pressurization characteristics match the desired inflation rate of the CPR-vest, and the maximum blower pressure corresponds to the desired peak vest pressure.

Despite the conventional wisdom that small high-pressure pumps should be used, applicant conceived of an application in a vest-CPR system where a blower is allowed to pressurize a vest up to and until the back pressure in the vest prevents the blower from moving more air into the vest. By matching the maximum blower pressure to the desired peak vest pressure, the inflation of the bladder ceases as the pressure in the vest rises to the desired peak pressure. The blower and vest back pressure regulate the bladder inflation such that the pressure in the vest does not rise substantially above the desired peak vest pressure.

Applicant has devised a vest-CPR system that does not require the complex and expensive pressure control and safety systems used in prior high pressure vest-CPR systems. By sizing a blower to have a maximum pressure corresponding to the desired peak vest pressure, and by driving the blower to its maximum pressure as the vest becomes fully inflated, the blower is the safety and control mechanism that ensures the vest will not be over inflated or pressurized. Accordingly, the use of a blower in a vest-CPR system increases the safety of the system, and reduces the system's expense and complexities by eliminating a high pressure air source and associated regulators and safety components.

BRIEF DESCRIPTION OF THE DRAWINGS

FIG. 1 is a simplified schematic diagram of a vest-CPR system constructed in accordance with the present invention;

FIG. 2 is a functional diagram of the CPR vest system shown in FIG. 1;

DETAILED DESCRIPTION OF THE DRAWINGS

Figure 3:
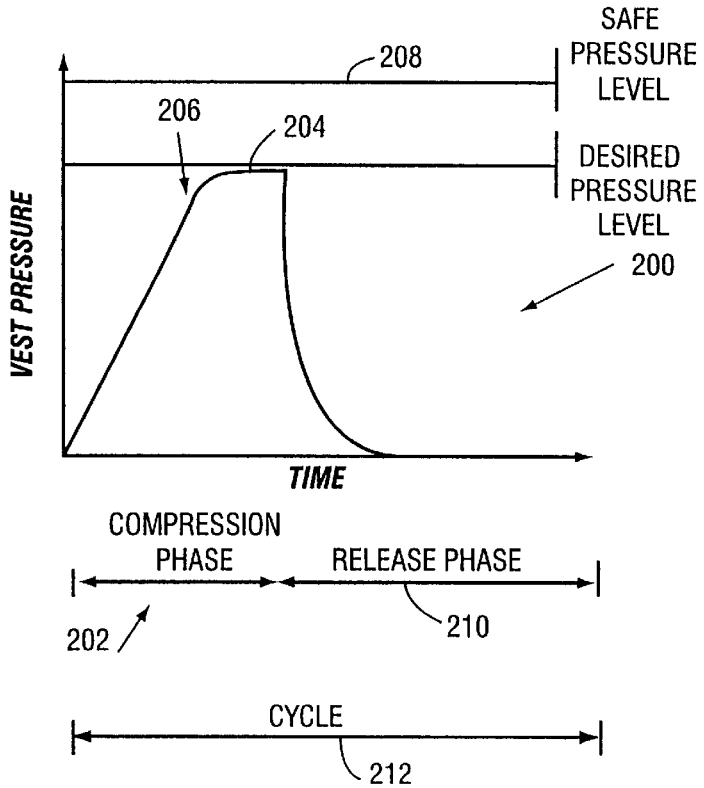
FIG. 3 is a chart of vest pressure verses time to illustrate the performance of the vest-CPR system shown in FIG. 1.

The vest-CPR system 100 shown in FIGS. 1 and 2 includes a CPR vest 102 and a blower-control system 104. The CPR vest includes a inextensible belt that fits around the thorax of the patient. Once the belt is wrapped around the patient, the belt is secured by a belt-hook or by Velcro strips. An inflatable bladder 105 is attached to an inner surface of the belt and the bladder is positioned over the front of the chest of the patient. The bladder may also be formed of an inextensible material to direct the expansion of the bladder towards the patient's chest. The CPR vest is described in more detail in co-pending application Ser. No. 08/404,442, entitled "Vest Design for a Cardiopulmonary Resuscitation System", filed by Mark Gelfand et al on Mar. 15, 1995, and commonly assigned with this application. The co-pending application is incorporated by reference with respect to its disclosure of the CPR vest.

The CPR vest 102 is connected via a pneumatic hose 107 to a blower-control system 104. The blower control system in the disclosed embodiment includes a relatively-simple pneumatic three-way valve 112 that cycles between coupling the vest to the blower and exhausting the vest bladder to the atmosphere or a vacuum. Pressurized air from the blower 106 inflates the vest when the valve routes the blower output air to the vest bladder. The timing of the compression and release cycles for the vest are controlled by a control circuit 122 in the blower control system.

The blower 106 draws ambient air in through an inlet port 108 and exhausts pressurized air from an outlet 110 in the range of 235±15 Torr. The blower may comprise a rotating axial fan or compressor, a centrifugal impeller or other equipment air or gas moving device. A suitable blower is the Windjammer® (Lamb Type B Model E-8698-2) manufactured by AMETEK of Kent, Ohio. This blower has a three-stage centrifugal fan/impeller (7.2 inch diameter) driven by a 1200 watt brushless motor at approximately 19,000 rpm. The blower is powered by a power supply 126 that may draw electrical power from a 120 volt AC wall socket and/or from a battery system 128.

The blower operates continuously while the vest CPR system is in operation. During most of its operating cycle, the blower will be operating at its maximum output pressure because the bladder is only inflated during a short period of the vest cycle. When operating at maximum pressure, the power consumed by the blower is minimal because the blower is not working to move air.

The outlet 110 to the blower 106 is connected to the three-way pneumatic valve 112 having an inlet 114 connected to the blower, an outlet 116 that is open to ambient air, and a common coupling 118 that is open to the outlet 116 or inlet 114 depending on the switch setting of the valve. The valve switch setting is controlled by a solenoid 120 which is governed by a timing control circuit 122. When a control voltage is applied to the solenoid by the control circuit, the valve 112 routes compressed air from the blower to the CPR vest pneumatic hose 105 connected to the common coupling 118. When the control voltage is turned off, the solenoid is de-energized and the valve returns to its rest state in which the common coupling is open to the exhaust outlet 116 to vent the pneumatic hose and vest bladder to the atmosphere.

A typical inflation-deflation cycle 200 shown in FIG. 3 shows that during the compression phase 202 the pressure in the vest 102 initially increases rapidly as the air flow rate from the blower is relatively high. The compression phase starts when the control circuit 122 energizes the solenoid which switches the valve 112 and routes pressurized air from the blower to the vest through the hose 105. Because the vest pressure is initially relatively low, the blower quickly moves a large mass of air into the vest to achieve rapid inflation. For example, a properly sized blower can pressurize the vest to between 50 to 100 Torr in 100 to 150 milliseconds.

Because of rapid pressurization, the vest compresses the patient's thorax to rapidly collapse the intrathoracic airways and trap air in the lungs. With trapped air, the lungs augment the compression of the chest by the vest to increase intrathoracic pressure. In addition, the inflation of the vest does not have to compensate for the shrinkage of the chest as the lungs deflate. Accordingly, the period of rapid pressurization during the initial period of the compression phase is a desirable characteristic provided by using a blower to inflate the vest.

As the vest reaches full pressurization (e.g., 400 to 500 milliseconds), the pressure in the vest applies increasingly more back pressure on the outlet 110 of the blower 106. The back pressure reduces the mass of air that flows out of the blower and slows the rate of pressurization of the vest. As the vest pressure approaches the desired pressure level 204 the rate of pressure increase in the vest slows, as is shown by the curve at 206 in FIG. 3. The blower is sized such that its maximum pressure corresponds to the desired peak pressure level 204 of the vest. For example, the desired peak vest pressure and maximum blower pressure may be 235 Torr, plus or minus 15 Torr. When the vest pressure rises to the desired peak pressure 204, the blower continues to operate at its maximum pressure level. If the vest leaks air or there is a loss of pressure in the vest, the continually operating blower quickly increases the vest pressure to the desired peak pressure. The valve 112 does not close the air path from the blower to the vest until the end of the compression phase 202. Even though the blower is not physically capable of pressurizing the vest beyond its maximum pressure level, the vest or pneumatic inflation line may have a safety pressure release valve 124 to depressurize the vest if its pressure exceeds a maximum safe pressure level 208.

At the start of the release phase 210, the valve switches to vent the air from the bladder to reduce the air pressure and deflate the bladder. The blower continues to operate at peak pressure during the release phase 210 when the blower outlet is capped by valve 112 such that the blower operates at its maximum pressure output and, coincidentally, its lowest energy consumption state. The output pressure from the blower does not drop from its maximum until the valve opens the vest to the blower air to start the compression phase 202 of another cycle. The blower operates continuously throughout the cycles 212 of the system.

The timer-control circuit 122 monitors the time of the compression period and the pressure in the vest 102 with a pressure sensor 130. The circuit 122 may include a microcontroller that tracks the time periods for the compression phase 202 and pressure release phase 210. The time of the compression period is pre-set in the control circuit 122, and may be 400 ms. To start the pressure release phase 210 at the end of the compression phase, the timer-control circuit deenergizes the solenoid 120 which switches the valve 112 and allows air in the vest to exhaust through the hose 105 and valve to the atmosphere. The pressure in the vest bladder quickly drops to ambient pressure or some other relatively low level. As the vest is depressurized, the compression applied to the patient's thorax is released. The release phase 210 of the cycle 212 continues until the start of the next compression phase. The valve remains open to vent the vest throughout the release period 210 which is a preset period, such as 600 ms. In addition, the patient will be periodically, such as every fifth CPR cycle, ventilated, i.e., allowed breath by natural or artificial means. While the patient is being ventilated, the CPR vest is fully deflated and the release phase is extended to about 850 ms, to allow the patient to breathe.

In addition, the timer control circuit 122 may switch the valve 112 to start an inflation cycle based on signals from monitors sensing the patient's heartbeat. When the vest-CPR system is used to assist a weakened but beating heart, the timing of the vest inflation phase must coincide with the actual heartbeat of the patient. To monitor the heartbeat, an electrocardiogram (ECG) instrument 123 may be used to sense the patient's heartbeat and generate a signal indicative of the heartbeat. The heartbeat signal is used by the timer control circuit 122 to determine when to switch the valve 112 so as to start the vest inflation phase. For example, the timing control circuit 122 may initiate the inflation phase of the vest a predetermined period of time following the QRS complex wave of the ECG signal. By timing the inflation of the vest to coincide with the actual heartbeat, the vest can be used to assist a beating, but weakened heart.

Figure 4:
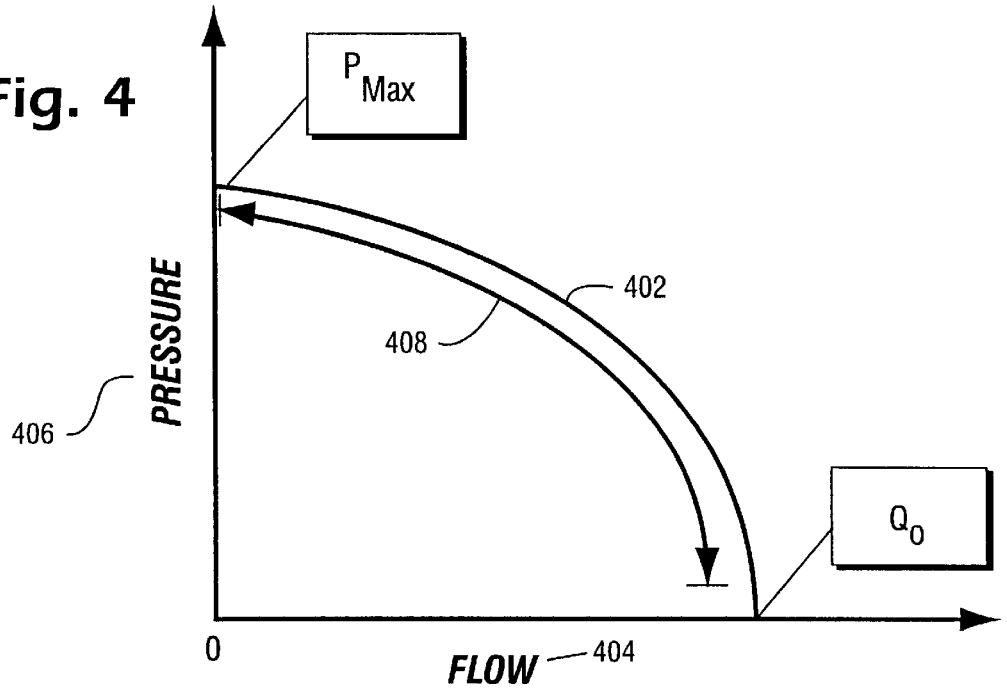
FIG. 4 is a chart of the performance of a blower for use in the vest-CPR system shown in FIG. 1.

FIG. 4 shows an exemplary performance chart for a blower operating at a constant speed. The curve 402 shows the operating states of the blower and demonstrates that the mass of air moved by the blower, i.e., flow 404, gradually reduces as the pressure rise 406 through the blower increases. The pressure rise is the pressure difference between the outlet and inlets to the blower. The maximum flow rate ($Q_0$) of the blower occurs when the blower does not substantially increase the air pressure. The maximum pressure ($P_{max}$) occurs when no air flows through the blower, such as when the back pressure on the blower equals the maximum pressure $P_{max}$. The blower pressure in a vest-CPR system will cycle 408 between $P_{max}$ and a deflated vest pressure 410 that approaches atmospheric air pressure, which corresponds to zero (0) pressure rise across the blower. Applicants have found by experimentation that the operating curve 402 of a blower corresponds well to the desired inflation cycle of a CPR-vest, such that the actual operating curve 408 for the blower in a vest-CPR system matches advantageously with the desired performance of the vest-CPR.

The invention has been described in connection with its preferred embodiment, but is not limited to the disclosed embodiment. The invention covers the various modifications and equivalent arrangements included within the spirit and scope of the appended claims regardless of whether the modifications and equivalent arrangements were known to the inventor(s) when filing the application for this patent.

What is claimed is:

1. A method for externally facilitating blood flow using a vest with a bladder for cyclically compressing a patient's chest to increase blood flow, a blower to inflate the bladder having a maximum pressure output for a given speed substantially equal to a desired peak bladder pressure, and a valve switchably coupling the blower to the bladder, said method comprising the following steps:

a. continuously operating the blower while cyclically compressing the chest with the vest;

b. switching the valve to place an outlet of the blower in fluid communication with the bladder;

c. inflating the bladder with air output by the blower until the blower reaches the maximum output pressure;

d. continuing to apply to the bladder the maximum output pressure from the blower until the valve is switched to vent air pressure from the vest; and e. repeating steps (b) to (d) to cyclically inflate and deflate the bladder.

2. A method for externally facilitating blood flow as in claim 1 wherein steps (b) is performed by a timing controller that periodically switches the valve between a first state of routing the inflation air from the blower to the bladder and a second state of venting air from the bladder.

3. A method for externally facilitating blood flow as in claim 2 wherein steps (b to e) are controlled by the timing controller that maintains the valve in the first state for a period of between 300 to 600 milliseconds and maintains the value in the second state for a period between 500 and 900 milliseconds.

4. A method for externally facilitating blood flow as in claim 2 further comprising step (f) of generating a signal indicative of a heartbeat of the patient, and wherein step (b) is further performed by applying the signal generated in step (f) to determine when to switch the valve to the first state.

5. A method for externally facilitating blood flow as in claim 2 wherein step (d) further includes operating the blower operates at the maximum pressure output after the valve is switched to vent air pressure from the vest.

6. A method for externally facilitating blood flow as in claim 1 wherein in step (c) the blower moves a maximum mass flow rate of air into the bladder during an initial inflation period of the bladder.

* * * * *